US006739708B2

(12) United States Patent
Studer et al.

(10) Patent No.: US 6,739,708 B2
(45) Date of Patent: May 25, 2004

(54) FLUID INTERCONNECT PORT VENTING FOR CAPILLARY RESERVOIR FLUID CONTAINERS, AND METHODS

(75) Inventors: Anthony D. Studer, Albany, OR (US); Kevin D. Almen, Albany, OR (US); David J. Benson, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/136,901

(22) Filed: Apr. 30, 2002

(65) Prior Publication Data

US 2003/0202063 A1 Oct. 30, 2003

(51) Int. Cl.[7] ..... B41J 2/175

(52) U.S. Cl. ..... 347/86

(58) Field of Search ..... 347/68, 85, 86, 347/87, 93

(56) References Cited

U.S. PATENT DOCUMENTS

| | | | | | |
|---|---|---|---|---|---|
| 4,015,272 | A | * | 3/1977 | Yamamori et al. | 347/68 |
| 5,537,134 | A | * | 7/1996 | Baldwin et al. | 347/85 |
| 5,790,158 | A | * | 8/1998 | Shinada et al. | 347/86 |
| 5,847,735 | A | * | 12/1998 | Betschon | 347/86 |
| 6,244,698 | B1 | * | 6/2001 | Chino et al. | 347/94 |
| 6,557,989 | B1 | * | 5/2003 | Hirosawa et al. | 347/87 |

* cited by examiner

*Primary Examiner*—Anh T. N Vo
(74) *Attorney, Agent, or Firm*—Larry D. Baker

(57) ABSTRACT

Disclosed are mechanisms and methods for venting the fluid interconnect port of fluid container that is at least partially filled with a capillary material. Preferred embodiments include venting a fluid container to ambient air with a vent located on the upper portion of the container; internally venting the container to channel air from the ambient air vent to an internal location adjacent to the fluid interconnect port; and then restrictedly venting the fluid port. Preferred embodiments also include positioning the restricted venting away from the bulk of the capillary material in the fluid container, and providing a capillary break and capillary accumulator adjacent to the fluid interconnect port.

24 Claims, 5 Drawing Sheets

Fig. 6
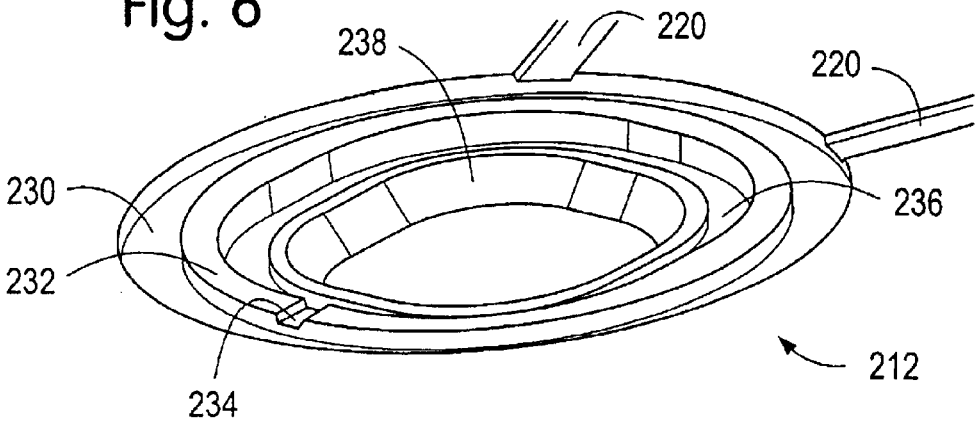
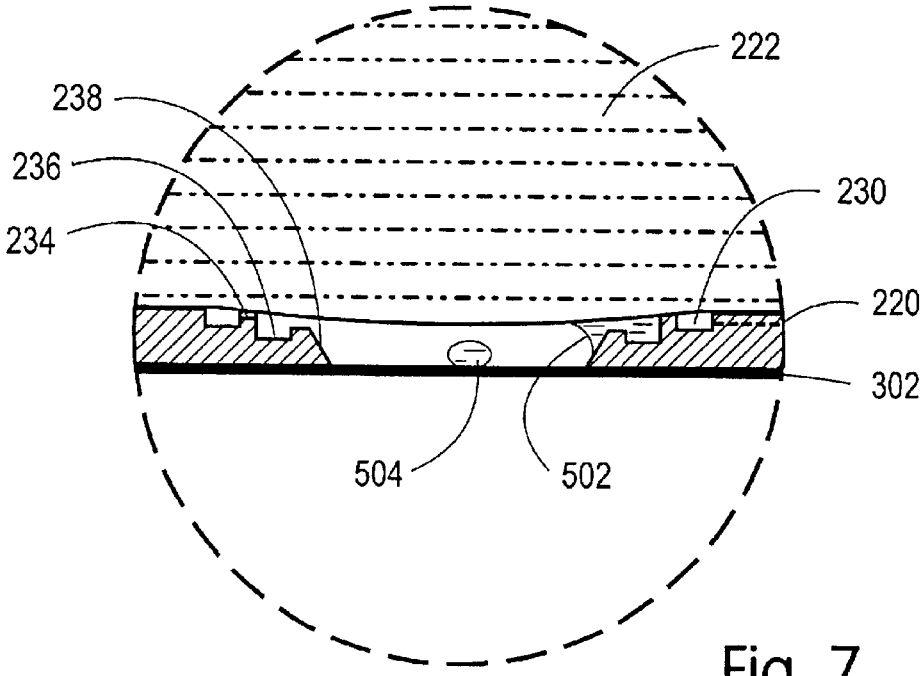
Fig. 7

FLUID INTERCONNECT PORT VENTING FOR CAPILLARY RESERVOIR FLUID CONTAINERS, AND METHODS

The present invention relates generally to replaceable fluid containers, and exemplary embodiments of the invention relate more specifically to mechanisms for preventing residual ink from accumulating in the sealed fluid interconnect port of a replaceable ink container.

BACKGROUND OF THE INVENTION

Ink jet printers are well known in the art. The most common type of ink jet printer uses thermal excitation of the ink to eject droplets through tiny nozzles, or orifices, onto a print media. Other ink jet mechanisms, such as the use of piezoelectric transducers as ink droplet generators, are also well understood. With all ink jet technologies, the ink jet pen is typically mounted on a carriage which is scanned across the print media; dot matrix manipulation of the droplets provides alphanumeric character and graphics printing capabilities. To provide a color printing capability, pens for each primary color (such as cyan, magenta, and yellow) are commonly used, typically in addition to black.

The ink jet pen itself may have a self-contained reservoir for storing ink and providing appropriate amounts of ink to the printhead during a printing cycle. These self-contained pens are commonly referred to in the art as print cartridges. If reusable, semi-permanent pens rather than print cartridges are employed, ink is either supplied from a remote off-axis (or off-board) ink reservoirs, or the ink reservoirs are mounted on the carriage with the pens.

In a typical ink jet printing system with semi-permanent pens and replaceable ink supplies, the replacement ink supplies are generally provided with seals over the fluid interconnects to prevent ink leakage and evaporation, and contamination of the interconnects during distribution and storage.

One form of replaceable ink jet ink container comprises a rigid container substantially filled with a capillary foam material, with a fluid interconnect port located at the bottom of the container. Fluid connection from the ink container to the printhead is made through a tower having a fine screen at its apex, which passes through the fluid interconnect port and presses against the capillary material. At the time of manufacture and prior to filling the container with ink, the fluid interconnect port of the container may be sealed with a sealing tape, which is removed by a consumer prior to installing the ink container in a printer.

A problem encountered with the use of sealing tape on fluid interconnects in this type of container is that residual ink may be present in the sealed fluid interconnect port, which was either deposited there during the container fill process, or was forced out of the capillary material when the container was dropped during shipping and handling. Particularly with pigmented inks, residual ink in the fluid interconnect port may be resistant to re-adsorption into the capillary material. When the sealing tape is removed for installation of the ink supply into the printer, the residual ink may contact the fingers or clothing of the installer, or be flung off the tape. Care must therefore be exercised when removing the sealing tape to avoid contact with any residual ink. The residual ink may also react with the adhesive on the sealing tape, contaminating the ink in the container; or in multi-colored ink containers, one color of ink may contaminate another.

There is therefore a need for mechanisms which reduce the occurrence of residual fluid in the fluid interconnect region of a replaceable container.

SUMMARY OF THE INVENTION

Embodiments of the present invention comprise venting mechanisms for allowing air to replace fluid in the sealed fluid interconnect port of a container substantially filled with a capillary material, thus enabling absorption of residual fluid into the container capillary material.

Other aspects and advantages of the present invention will become apparent from the following detailed description, taken in conjunction with the accompanying drawings, illustrating by way of example the principles of the invention.

BRIEF DESCRIPTION OF THE DRAWINGS

FIG. 6 is an enlarged view of area 6—6 of FIG. 4, illustrating in detail features of an embodiment of the fluid interconnect port venting features of the present invention.

FIG. 7 is an enlarged view of area 7—7 of FIG. 5, illustrating in detail features of an embodiment of the fluid interconnect port venting features of the present invention.

DESCRIPTION OF THE PREFERRED EMBODIMENT

Figure 1:
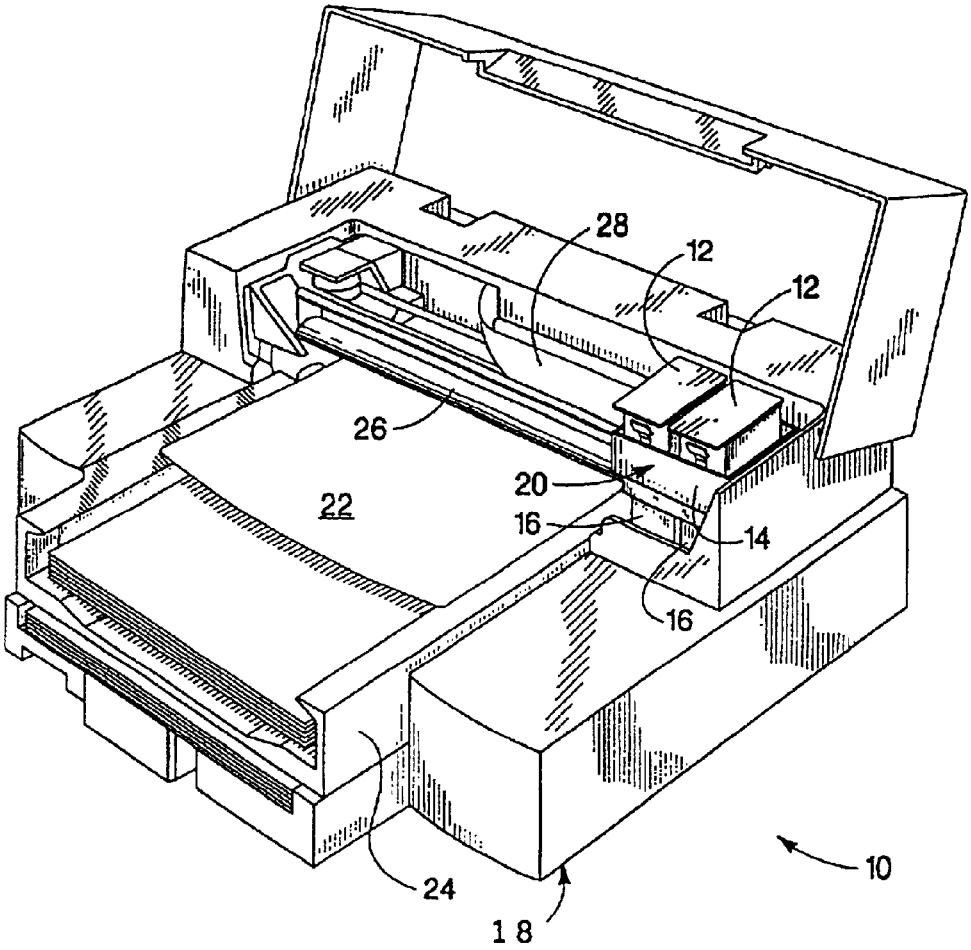
FIG. 1 is a perspective view of an exemplary ink jet printing system in which ink containers incorporating the fluid interconnect port venting features of the present invention may be incorporated.

FIG. 1 is a perspective view of a typical ink jet printing system 10 shown with its cover open. The printing system includes a plurality of replaceable ink containers 12 that are installed in a receiving station 14. Ink is provided from the replaceable ink containers 12 through a manifold (not visible in this view) to inkjet printheads 16. The inkjet printheads 16 are responsive to activation signals from the printer portion 18 to deposit ink on print media. As ink is ejected from the printheads 16, the printheads are replenished with ink from the ink containers 12. The ink containers 12, receiving station 14, and inkjet printheads 16 are each part of a scanning carriage that is moved relative to a print media 22 to accomplish printing. The printer portion 18 includes a media tray for receiving the print media 22. As the print media 22 is stepped through a print zone, the scanning carriage 20 moves the printheads 16 relative to the print media 22. The printer portion 18 selectively activates the printheads 16 to deposit ink on print media 22 to thereby print on the media.

The scanning carriage 20 is moved through the print zone on a scanning mechanism which includes a slide rod 26 on which the scanning carriage 20 slides as the scanning carriage 20 moves through a scan axis. A positioning means (not shown) is used for precisely positioning the scanning carriage 20. In addition, a paper advance mechanism (not shown) is used to step the print media 22 through the print zone as the scanning carriage 20 is moved along the scan axis. Electrical signals are provided to the scanning carriage 20 for selectively activating the printheads 16 by means of an electrical link such as a ribbon cable 28.

Figure 2:
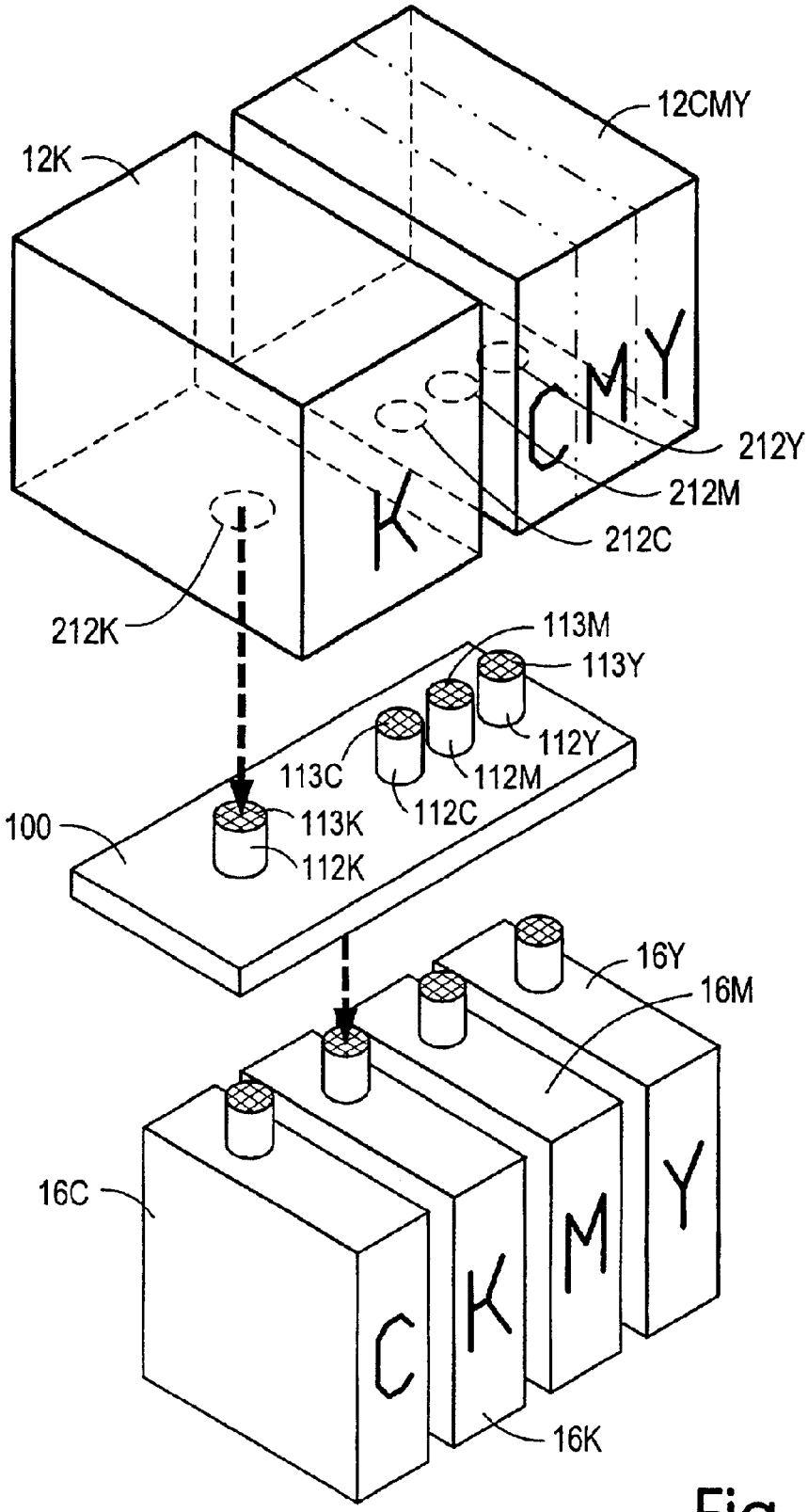
FIG. 2 is a simplified representation of the ink supplies, coupling manifold, and printheads of an exemplary ink jet printing system.

FIG. 2 is a simplified diagram further illustrating the scanning portion of an exemplary ink delivery system (for clarity, the supporting structure of the scanning carriage 20 is omitted). In the exemplary printing system, a pair of replaceable ink containers 12, typically one for black ink and one for color ink, are installed in the receiving station 14. The ink containers are substantially filled with a hydrophilic capillary material, as discussed below, which serves to retain the ink. Attached to the base of the receiving station is a manifold 100. Inkjet printheads 16 are in fluid communication with the receiving station 14 through the manifold. In the embodiment illustrated, the inkjet printing system includes a tri-color ink container 12CMY containing three separate ink colors (cyan, magenta, and yellow) and a second ink container 12K containing black ink. The replaceable ink containers 12CMY, 12K can be partitioned differently to contain fewer than three ink colors or more than three ink colors if more are required. For example, in the case of high fidelity printing, frequently six or more colors may be used.

The specific configuration of ink reservoirs and printheads illustrated in FIG. 2 is one of many possible configurations. Towers on the manifold 112K, 112C, 112M, 112Y, engage the fluid interconnect ports 212K, 212C, 212M, 212Y of the replaceable ink supplies. The towers include fine mesh filters 113K, 113C, 113M, 113Y at their apexes which contact the capillary material within the ink containers (not shown in FIG. 2) to establish a reliable fluid interconnect. Internal channels within the manifold (not shown) route the various ink colors to the appropriate printheads 16K, 16C, 16M, and 16Y (for illustrative purposes the path followed by the black ink is illustrated with a thick dashed line).

Figure 3:
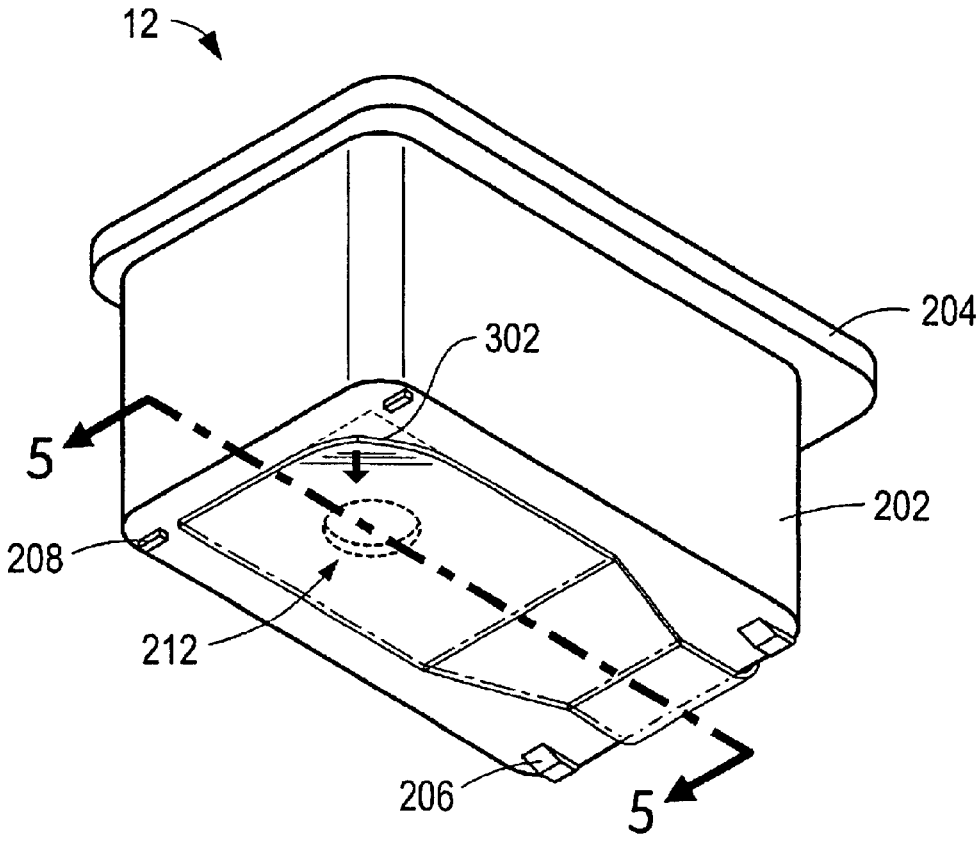
FIG. 3 a simplified representation of an exemplary replacement ink supply, illustrating how sealing tape is typically placed over the fluid interconnect during manufacture.

FIG. 3 is a simplified representation of a replacement ink container 12, illustrating how a removable sealing tape or label 302 is typically used to seal the fluid interconnect port 212 for transport and storage (the ink container illustrated is a single color container, such as would typically be used for black ink; however, embodiments of the present invention may also be utilized in multi-ink containers). The exemplary container comprises a body portion 202 and a lid portion 204. The body portion contains a hydrophilic capillary material (not visible in FIG. 3) to retain ink, such as bonded polyester fiber (BPF), polyurethane, or melamine. Small front spacing members or feet 208 and rear spacing members or feet 206 prevent the fluid interconnect port from contacting a flat surface on which the container is resting, such as a customer's desk, and potentially depositing residual ink (after seal 302 has been removed). The rear feet 206 also form part of the venting mechanisms of the present invention, as discussed below.

Typically the seal 302 is attached with a mild adhesive that permits the seal or label to be easily removed by the consumer. As the seal is removed from the container, any residual ink in the fluid interconnect port or on the back side of the label or seal may come into contact with the installer's fingers or clothes, or may be flung from the label. Prolonged interaction between residual ink and the adhesive on the seal can also affect properties of the ink, potentially degrading print quality. With multi-color reservoirs, it is also possible for one color of ink to contaminate another.

Residual ink in the sealed fluid interconnect port is reduced or eliminated in embodiments of the present invention by enabling the ink to absorb into the capillary material within the ink container. The present invention provides venting mechanisms channeling air from outside the container to the fluid interconnect port, which facilitates adsorption. Embodiments of the venting mechanisms are configured to limit the amount of air reaching the fluid interconnect port, such that potential air ingestion by the ink jet pen (and possible de-priming) is avoided, and to also minimize stranded isolated ink drops left on the sealing label due to too rapid adsorption of the ink into the capillary material. The venting mechanisms may also preferably be configured such that they do not serve as channels facilitating ink entry into the fluid interconnect port during container filling or as a result of shock to the container.

Figure 4:
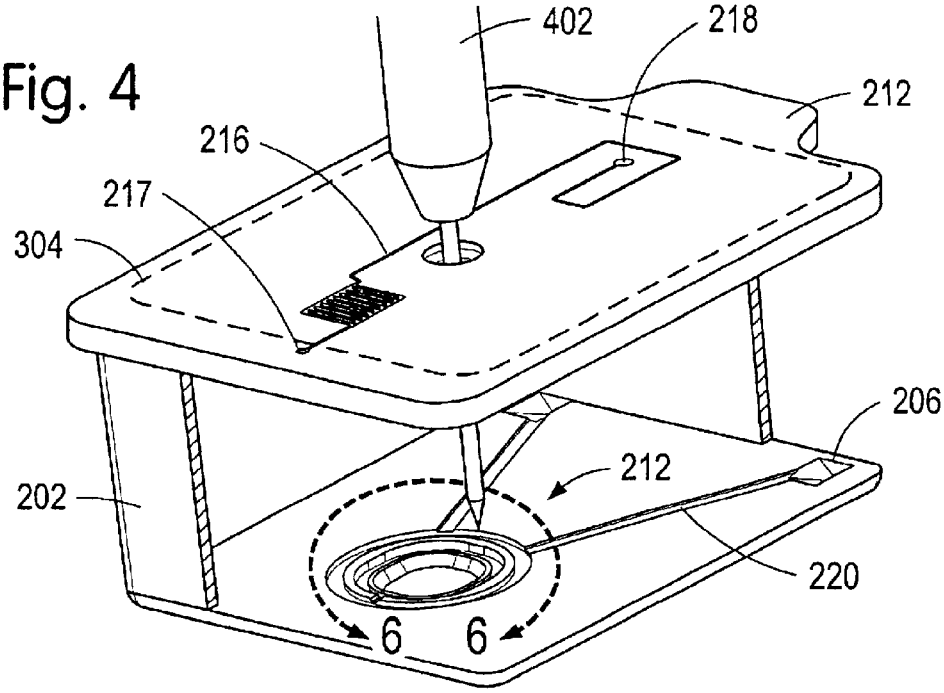
FIG. 4 is a partial cutaway view of an exemplary ink jet container during the "fill" process, illustrating an embodiment of the fluid interconnect port venting features of the present invention.

FIG. 4 is a partial cutaway view of an exemplary ink jet container during the "fill" process, illustrating an embodiment of the fluid interconnect port venting features of the present invention (the capillary material in the container is omitted for clarity). The container is shown together with a fill needle 402, indicating how ink is initially introduced into the container. A preferred embodiment of the present invention includes a vent system formed in the container lid (217, 216, 218), as is known in the art; provisions for allowing air passage around the end of the capillary material; redundant vent paths (206, 220) formed in the floor of the container to provide air from the end of the container to the fluid interconnect port region; and features adjacent to the fluid interconnect port 212 to facilitate and regulate the absorption of ink into the capillary material. Each of these features is discussed in detail below.

Rigid ink containers are typically vented in some fashion to allow air to replace ink in the container as the ink is depleted and to maintain a suitable operating pressure in the container (another form of container uses a flexible bag that collapses as the ink is utilized). One form of vent is a very small passageway, usually serpentine, which allows air to slowly enter the container while effectively blocking the ink, due to the ink's surface tension.

FIG. 4 illustrates one exemplary approach to venting a fluid container. A narrow serpentine depression 216 is molded on the surface of the container lid connected at one end with a shallow depression 217, and at the other end with a hole 218 passing through the lid. After the container is filled with ink and the fill needle removed from the fill hole, a top label 304 (shown in dashed lines in FIG. 4) is affixed to the lid, serving to seal the fill hole and close the open side of the serpentine depression, thus forming a serpentine vent path 216 leading from the shallow depression 217 to the hole 218. External ambient air may pass from the shallow depression (which is not covered by the label 304), along the serpentine path 216 under the label 304, and through the hole 218 into the container interior. Although a single vent is illustrated, multiple vents may also be used. Other approaches to venting the ink container may also be employed; such as, for example, other forms of serpentine vents.

Figure 5:
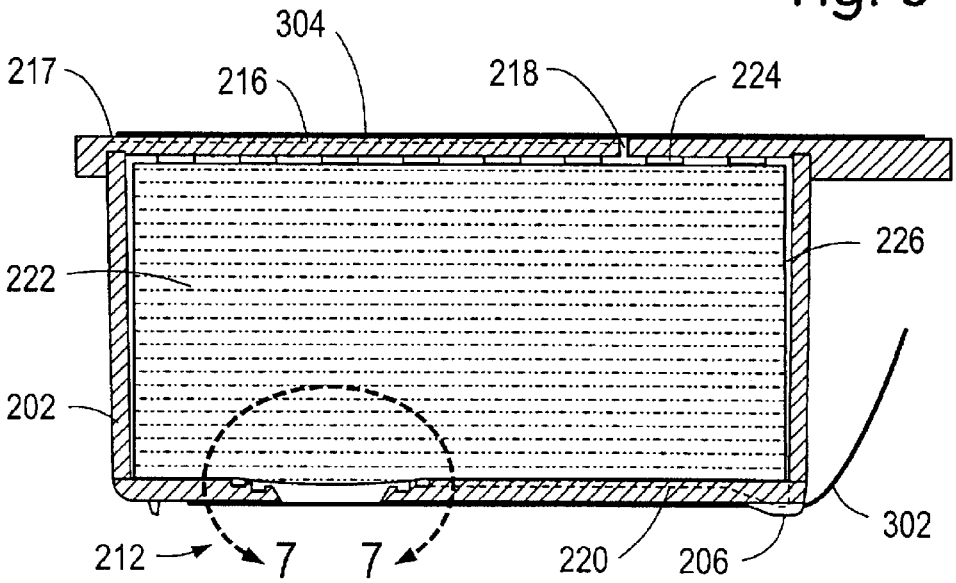
FIG. 5 is a cross-sectional view along line 5—5 of FIG. 3, illustrating an embodiment of the fluid interconnect port venting features of the present invention.

FIG. 5 is a cross-sectional view along line 5—5 of FIG. 3, further illustrating interior details of the exemplary fluid container. As seen in FIG. 5, the underside of the lid 212 includes spacing members 224, which may be in the form of castellations integrally molded with the lid. These spacing members serve to insure that air from the container vent may move into the capillary material 222, replacing ink as the ink is withdrawn from the container during printing. The spacing members also permit air to move to the end wall 226 of the container.

To provide a mechanism for air to pass from the top of the container around the capillary material 222, the preferred embodiment of the invention contemplates exploiting a characteristic of the preferred capillary material, bonded polyester fiber (BPF). BPF is composed of multiple fiber strands bonded together, and as a result has a "grain", or preferred capillary direction, running the direction of the fibers. The fibers are oriented lengthwise in the container, as represented by the dashed lines in FIG. 5, such that an "end grain" of the material is adjacent to the container interior end wall 226. When the BPF material is in loose contact with the end wall 226 of the container, it has been empirically determined that sufficient air can flow along the end grain of the capillary material to meet the requirements of the fluid port vent, even when the capillary material is saturated with ink. If another capillary material is used in place of BPF (such as, for example, polyurethane foam or melamine), additional provisions for allowing air to pass from the top of the container around the capillary material may be required. The additional provisions may include vent channels (not shown) similar to the redundant vent channels 220 formed on the floor of the container.

For providing venting from the end of the container 226 to the fluid interconnect port 212, the preferred embodiment includes redundant vent channels 220, which are small troughs molded into the container floor. The interior of rear feet 206 are utilized as small air chambers to provide reliable air communication from the end of the container to the vent channels. In other reservoir embodiments, a single vent trough may be used, or other methods of providing venting from the container end to the fluid interconnect port region may be employed.

Around the interconnect port 212 of the preferred embodiment are a number of features to both facilitate ink adsorption, and retard the speed of adsorption, as discussed below with respect to FIGS. 6 and 7.

The present invention thus provides a vent path for air to reach the fluid interconnect port to displace ink as the ink is drawn by capillary forces back into the capillary material (in the absence of a vent path, ink would be drawn into the capillary material only until the vacuum pressure in the port equaled the capillary forces acting on the ink). While the vent path should allow air to reach the fluid interconnect port, it has been empirically determined that the capacity and number of vent paths should be restricted in order to avoid several potential problems.

First, the fluid connections between the containers 12K, 12CMY and the printing system rely on good contact between the mesh filters (113K through 113Y in FIG. 2) of the manifold towers (112K through 112Y of FIG. 2) and the ink-filled capillary material. If too large of a vent capacity is provided to the fluid interconnect port, this connection can be compromised, and the printing system can ingest air. In the absence of any venting of the fluid interconnect port, air replaces ink in the capillary material from the top of the container as ink in withdrawn from the bottom, with the capillary material near the interconnect port remaining heavily saturated with ink. If a large venting capacity is provided to the fluid interconnect port, ink can be depleted in the fluid interconnect region of the capillary material, as air locally replaces the ink. The result can be incomplete utilization of the ink within the container (the container may seem empty, while a substantial quantity of ink remains), and potential depriming of the ink delivery system.

Second, it has been empirically determined that if ink that is pooled in the fluid interconnect port adjacent to the label is withdrawn too quickly, isolated drops of ink may be left stranded on the label (such as illustrated at 504 in FIG. 7). These isolated drops form because the ink has inertia and may also slightly adhere to the label; the capillary forces and surface tension pull the surrounding ink out of the fluid port before the drops acquire sufficient velocity to exit the port. Once the ink surrounding the drops has been withdrawn, the forces which would normally act to pull the drops back into the container's capillary material are absent, and the drops remain on the label. When a customer removes the label to install the container in a printer, these drops may contact the customer's hands or clothing, or be flung off the label. It is therefore desirable to limit the vent capacity to slow the withdrawal of ink from the interconnect port.

Third, air vent paths into the fluid interconnect area may also function as paths for ink to enter fluid interconnect area both during ink fill and when the container undergoes a shock, such as from shock and vibration during shipping and handling, or from being dropped by the customer. It is therefore desirable to orient and size any venting paths in such a manner that they do not readily form ink conduits.

Thus, the interconnect port features of the preferred embodiment are configured to adequately vent the interconnect port while limiting the flow of air to the port. The interconnect port features are shown in detail in FIGS. 6 and 7, with FIG. 6 being an enlarged view of area 6—6 of FIG. 4, and FIG. 7 being an enlarged view of area 7—7 of FIG. 5. The features include an air path ring 230, a wall 232 with a small air vent 234, a capillary break 238, and a capillary accumulator 236.

The air path ring 230, which surrounds the fluid interconnect port, is in air communication with the two redundant vent paths 220 (and thus, through the container venting mechanisms, with the ambient air outside the container). The purpose of the air path ring is to channel air to the small vent 234 formed in the wall 232 and to serve as a local source of air for the small vent; the small vent or passageway serves to restrict or slow down venting of the fluid port.

As discussed above, the small vent 234 is intentionally restricted in size such that adsorption of residual ink into the capillary material is slowed, and so as to reduce potential paths for ink to enter the fluid interconnect port during ink fill or as the result of shock and vibration. The small vent 234 acts as an air flow restrictor, limiting the rate at which air is vented into the fluid interconnect port. Since the optimal size of the vent is dependent upon many factors, it is best determined empirically through testing. In tests that examined containers for residual ink droplets on the fluid interconnect seal portion of the label (as shown at 504 in FIG. 7), vents with a smallest dimension ranging up to 0.015 inches were evaluated, and a vent with a smallest dimension of 0.009 inches was found to perform best in the exemplary ink container. In other container embodiments, a different smallest dimension may be more effective.

In a container in which the fluid port is located towards one end of the container, such as best seen in FIGS. 4 and 5, the small vent 234 is preferably located on the side of the fluid interconnect port that is away from the bulk of the capillary material. This placement reduces the possibility that the vent will serve as a fluid conduit for ink intrusion into the port during ink filling, or when the container is dropped.

Immediately surrounding the fluid interconnect port of the preferred embodiment are a capillary break 236 and a capillary accumulator 238. The capillary break 236 is preferably a flat counter bore on the inside of the rigid container body 202 around the fluid interconnect port. This capillary break functions by capturing excess ink in the inside corner of the counter bore. Any ink that crosses into the fluid interconnect region travels down the vertical wall of the break. If there is not an excessive amount of ink it will gather in the annular ring of the corner formed by the counterbore, which has a higher capillary force than the flat surfaces. For the ink to travel across the flat surface of the counter bore it would have to be of sufficient quantity to overcome the capillarity force of the corner to flow into the fluid interconnect region and come in contact with the label. The capillary break may take forms other than a flat counterbore, provided that there is a region with a high capillarity adjacent to one of low capillarity, such that ink is impeded from crossing the region of low capillarity.

The capillary accumulator 238 preferably comprises a chamfer on the walls of the fluid interconnect. The chamfer forms a small contact angle between the capillary material 222 in the reservoir and the supply body. This angle provides a capillary force that will hold a quantity of ink in contact with the capillary material 222 of the container, where it can be adsorbed. The capillary force acts over time to speed up the process of driving the residual ink out of the fluid connect area and back into the foam reservoir. Residual ink 502 is thus contained by the accumulator until it is absorbed into the capillary material; the volume formerly occupied by the ink is replace by air flowing through the small vent 234. The capillary accumulator may take other forms than a chamfer, provided that ink is held against the capillary material.

An advantage of the capillary break and accumulator is that they permit rapid filling of the ink container while holding residual ink away from the fluid interconnect region. A further advantage is that they provide the container with an area to store ink that could come out of the capillary material over time due to altitude excursions, dropping, or shipping. This ability to locally retain residual ink resulting from environmental and stress events keeps ink away from the fluid interconnect label or seal.

The methods of the present invention thus include venting a fluid container to ambient air with a vent located on the upper portion of the container; internally venting the container to channel air from the ambient air vent to an internal location adjacent to the fluid interconnect port; and then restrictedly venting the fluid port. The methods also include positioning the restricted venting away from the bulk of the capillary material in the ink container, and providing a capillary break and capillary accumulator on the fluid interconnect port.

Although the exemplary embodiments of the invention relate to replaceable ink containers for inkjet printers, the present invention may be used for containers of other consumable liquids, and in other applications. Aspects of the venting mechanisms may also be used independently; such as, for example, utilizing restricted venting to slow down the adsorption of fluid into a capillary material to prevent formation of residual fluid drops or the depriming of a fluid delivery system, though the local source of vent air is provided through a mechanism other than disclosed herein. The invention may also be used with alternative fluid container designs, such as, for example, containers only partially filled with a capillary material.

While the present invention has been particularly shown and described with reference to the foregoing preferred and alternative embodiments, those skilled in the art will understand that many variations may be made therein without departing from the spirit and scope of the invention as defined in the following claims. This description of the invention should be understood to include all novel and non-obvious combinations of elements described herein, and claims may be presented in this or a later application to any novel and non-obvious combination of these elements. The foregoing embodiments are illustrative, and no single feature or element is essential to all possible combinations that may be claimed in this or a later application. Where the claims recite "a" or "a first" element of the equivalent thereof, such claims should be understood to include incorporation of one or more such elements, neither requiring nor excluding two or more such elements.

What is claimed is:

1. A fluid port vent for a fluid container, the container having an internal volume at least partially filled with a capillary material, with a fluid port positioned substantially below the capillary material and allowing a fluid connection with the capillary material from outside of the container, and a source of air substantially at ambient pressure within the container; the fluid port vent comprising:

an air flow restrictor interposed between the source of air and the fluid port, the air flow restrictor comprising a wall formed in the container internal volume substantially blocking a flow of air from the source of air to the fluid port; and a small vent passageway formed in the wall, the small vent passageway having a smallest dimension of no greater than 0.015 inches.

2. A fluid port vent for a fluid container, the container having an internal volume at least partially filled with a capillary material, with a fluid port positioned substantially below the capillary material and allowing a fluid connection with the capillary material from outside of the container, and a source of air substantially at ambient pressure within the container; the fluid port vent comprising:

an air flow restrictor interposed between the source of air end the fluid port, the air flow restrictor comprising a wall farmed in the container internal volume substantially blocking a flow of air from the source of air to the fluid port;

a small vent passageway formed in the wall;

and wherein the capillary material further has two ends, the fluid interconnect port is offset towards one of the two ends, and the small vent passageway is located between the fluid port and the end nearest to the fluid port.

3. In a fluid reservoir having a substantially rigid outer shell with an upper portion and a lower portion, the shell enclosing an interior containing a capillary material and having fluid interconnect port forming an opening through the rigid shell lower portion into the interior, a fluid port vent, comprising:

a reservoir vent in the top portion providing air communication between the shell interior and ambient air;

a venting mechanism in the reservoir interior providing air communication between the reservoir vent to an area adjacent to the fluid interconnect port;

an air passageway providing restricted air communication between the area adjacent to the fluid interconnect cart and the fluid interconnect port;

a wall formed in the container interior substantially blocking air flow between the area adjacent to the fluid interconnect cart and the fluid interconnect port, and wherein the air passageway providing restricted air communicating is a small vent formed in the wall;

and wherein the small vent has a smallest dimension no greeter than 0.015 inches.

4. In a fluid reservoir having a substantially rigid outer shell with an upper portion and a lower portion, the shell enclosing an interior containing a capillary material and having fluid interconnect port forming an opening through the rigid shell lower portion into the interior, a fluid port vent, comprising:

a reservoir vent in the top portion providing air communication between the shell interior and ambient air;

a venting mechanism in the reservoir interior providing air communication between the reservoir vent to an area adjacent to the fluid interconnect port;

an air passageway providing restricted air communication between the area adjacent to the fluid interconnect port and the fluid interconnect port;

and wherein the venting mechanism in the reservoir interior comprises an air ring formed in the rigid shell interior lower portion, the air ring encircling the fluid interconnect port.

5. In a fluid reservoir having a substantially rigid outer shell with an upper portion and a lower, portion, the shell enclosing an interior containing a capillary material and having fluid interconnect port forming an opening through the rigid shell lower portion into the interior, a fluid port vent, comprising:

a reservoir vent in the top portion providing air communication between the shell interior and ambient air;

a venting mechanism in the reservoir interior providing air communication between the reservoir vent to an area adjacent to the fluid interconnect port;

an air passageway providing restricted air communication between the area adjacent to the fluid interconnect cart and the fluid interconnect port;

and further comprising at least one foot integrally formed in the rigid shell lower portion, and wherein the venting mechanism in the reservoir interior comprises a depression in the rigid shell interior lower portion substantially conforming to the fool.

6. In a fluid reservoir having a substantially rigid outer shell with an upper portion and a lower portion, the shell enclosing an interior containing a capillary material and having fluid interconnect port forming an opening through the rigid shell lower portion into the interior, a fluid port vent, comprising:

a reservoir vent in the top portion providing air communication between the shell interior and ambient air;

a venting mechanism in the reservoir interior providing air communication between the reservoir vent to an area adjacent to the fluid interconnect port;

an air passageway providing restricted air communication between the area adjacent to the fluid interconnect port and the fluid interconnect port;

and wherein the venting mechanism in the reservoir interior comprises:

the substantially rigid outer shell further having at least one interior end wall, with the capillary material in loose contact with the interior end wall;

the capillary material having a preferred capillary direction;

the preferred capillary direction oriented substantially perpendicular to the rigid outer shell interior end wall, such that air may move along the shell interior end wall.

7. The fluid port vent of claim 6, wherein the capillary material comprises bonded polyester fiber (BPF).

8. In a fluid reservoir having a substantially rigid outer shell with an upper portion and a lower, portion, the shell enclosing an interior containing a capillary material and having fluid interconnect port forming an opening through the rigid shell lower portion into the interior, a fluid port vent, comprising:

a reservoir vent in the top portion providing air communication between the shell interior and ambient air;

a venting mechanism in the reservoir interior providing air communication between the reservoir vent to an area adjacent to the fluid interconnect port;

an air passageway providing restricted air communication between the area adjacent to the fluid interconnect cart and the fluid interconnect port; and further comprising a capillary break surrounding the opening through the outer container lower portion, the capillary break formed in the outer container lower portion.

9. The fluid port vent of claim 8, wherein the capillary break comprises a flat counterbore.

10. In a fluid reservoir having a substantially rigid outer shell with an upper portion and a lower portion, the shell enclosing an interior containing a capillary material and having fluid interconnect port forming an opening through the rigid shell lower portion into the interior, a fluid port vent, comprising:

a reservoir vent in the top portion providing air communication between the shell interior and ambient air;

a venting mechanism in the reservoir interior providing air communication between the reservoir vent to an area adjacent to the fluid interconnect port;

an air passageway providing restricted air communication between the area adjacent to the fluid interconnect cart and the fluid interconnect port;

and further comprising a capillary accumulator surrounding the opening through the outer container lower portion, the capillary break formed in the outer container lower portion.

11. The fluid port vent of claim 10, wherein the capillary accumulator comprises a chamfer.

12. A replaceable container for a consumable liquid, comprising:

a fluid reservoir having a substantially rigid outer container with a top portion and a bottom portion, the container having an interior substantially filled with a capillary material, and a fluid interconnect port forming an opening through the outer container lower portion into the interior;

a container vent in the top portion providing air communication between the interior and ambient air;

a venting mechanism in the reservoir interior providing air communication between the container vent to an area adjacent to the fluid interconnect port;

a passageway providing limited air communication between the area adjacent to the fluid interconnect port and the fluid interconnect port;

a wall formed in the container interior blocking airflow between the area adjacent to the fluid interconnect port end the fluid interconnect port, and wherein the passageway providing limited air communication is a small vent formed in the wall;

and wherein the small vent has a smallest dimension no greater than 0.015 inches.

13. A replaceable container for a consumable liquid, comprising:

a fluid reservoir having a substantially rigid outer container with a top portion and a bottom portion, the container having an interior substantially filled with a capillary material, and a fluid interconnect port forming an opening through the outer container lower portion into the interior;

a container vent in the top portion providing air communication between the interior and ambient air;

a venting mechanism in the reservoir interior providing air communication between the container vent to an area adjacent to the fluid interconnect port;

a passageway providing limited air communication between the area adjacent to the fluid interconnect port and the fluid interconnect port;

and wherein the venting mechanism in the reservoir interior comprises an air ring formed in the rigid container interior bottom portion, the air ring encircling the fluid interconnect port.

14. A replaceable container for a consumable liquid, comprising:

a fluid reservoir having a substantially rigid outer container with a top portion and a bottom portion, the container having an interior substantially filled with a capillary material, and a fluid interconnect port forming an opening through the outer container lower portion into the interior; a container vent in the top portion providing air communication between the interior and ambient air;

a venting mechanism in the reservoir interior providing air communication between the container vent to an area adjacent to the fluid interconnect port;

a passageway providing limited air communication between the area adjacent to the fluid interconnect port and the fluid interconnect port;

and wherein the venting mechanism in the reservoir interior comprises a depression in the rigid container interior bottom portion substantially conforming to the foot.

15. A replaceable container for a consumable liquid, comprising:

a fluid reservoir having a substantially rigid outer container with a top portion and a bottom portion, the container having an interior substantially filled with a capillary material, and a fluid interconnect port forming an opening through the outer container lower portion into the interior;

a container vent in the top portion providing air communication between the interior and ambient air;

a venting mechanism in the reservoir interior providing air communication between the container vent to an area adjacent to the fluid interconnect port;

a passageway providing limited air communication between the area adjacent to the fluid interconnect port and the fluid interconnect port;

and wherein the venting mechanism in the reservoir interior comprises:

the substantially rigid outer container further having at least one interior end wall, with the capillary material in loose contact with the interior end wall;

the capillary material having a preferred capillary direction; the preferred capillary direction oriented substantially perpendicular to the rigid container shell interior end wall, such that air may move along the container interior end wall.

16. The replaceable container for a consumable liquid of claim 15, wherein the capillary material comprises bonded polyester fiber (BPF).

17. A replaceable container for a consumable liquid, comprising:

a fluid reservoir having a substantially rigid outer container with a top portion and a bottom portion, the container having an interior substantially filled with a capillary material, and a fluid interconnect port forming an opening through the outer container lower portion into the interior;

a container vent in the top portion providing air communication between the interior and ambient air;

a venting mechanism in the reservoir interior providing air communication between the container vent to an area adjacent to the fluid interconnect port;

a passageway providing limited air communication between the area adjacent to the fluid interconnect port and the fluid interconnect port;

and further comprising a capillary break surrounding the opening through the outer container bottom portion, the capillary break formed in the outer container bottom portion.

18. The replaceable container for a consumable liquid of claim 17, wherein the capillary break comprises a flat counterbore.

19. A replaceable container for a consumable liquid, comprising:

a fluid reservoir having a substantially rigid outer container with a top portion and a bottom portion, the container having an interior substantially filled with a capillary material, and a fluid interconnect port forming an opening through the outer container lower portion into the interior;

a container vent in the top portion providing air communication between the interior and ambient air;

a venting mechanism in the reservoir interior providing air communication between the container vent to an area adjacent to the fluid interconnect port;

a passageway providing limited air communication between the area adjacent to the fluid interconnect port and the fluid interconnect port; and further comprising a capillary accumulator surrounding the opening through the outer container bottom portion, the capillary break formed in the outer container bottom portion.

20. The replaceable container for a consumable liquid of claim 19, wherein the capillary accumulator comprises a chamfer.

21. A method of venting the fluid interconnect port of a fluid container, the fluid container having a substantially rigid outer shell with an upper portion an interior substantially filled with a capillary material a lower portion and a fluid interconnect port forming an opening through the outer container lower portion into the interior, the method comprising:

venting the fluid container to ambient air with a vent located on the upper portion of the container;

internally venting the container to channel air from the ambient air vent to an internal location adjacent to the fluid interconnect port;

restrictedly venting the fluid port from the adjacent location;

and retaining residual ink with a capillary break adjacent to the fluid interconnect port.

22. The method of venting the fluid interconnect port of a fluid container of claim 21, wherein in the capillary break comprises a flat counterbore surrounding the opening through the outer container lower portion.

23. A method of venting the fluid interconnect port of a fluid container, the fluid container having a substantially rigid outer shell with an upper portion an interior substantially filled with a capillary material a lower portion and a fluid interconnect port forming an opening through the outer container lower portion into the interior, the method comprising:

venting the fluid container to ambient air with a vent located on the upper portion of the container;

internally venting the container to channel air from the ambient air vent to an internal location adjacent to the fluid interconnect port;

restrictedly venting the fluid port from the adjacent location;

and accumulating residual ink with a capillary accumulator adjacent to the fluid interconnect port.

24. The method of venting the fluid interconnect port of a fluid container of claim 21, wherein in the capillary accumulator comprises a chamfer surrounding the opening through the outer container lower portion.

* * * * *

UNITED STATES PATENT AND TRADEMARK OFFICE

CERTIFICATE OF CORRECTION

PATENT NO. : 6,739,708 B2
DATED : May 25, 2004
INVENTOR(S) : Studer et al.

It is certified that error appears in the above-identified patent and that said Letters Patent is hereby corrected as shown below:

Column 8,
Line 36, delete "end" and insert in lieu thereof -- and --;
Line 37, delete "farmed" and insert in lieu thereof -- formed --;
Lines 59 and 63, delete "cart" and insert in lieu thereof -- port --;
Line 65, delete "communicating" and insert in lieu thereof -- communication --;
Line 67, delete "greeter" and insert in lieu thereof -- greater --;

Column 9,
Line 21, delete the comma between "lower" and "portion";
Line 23, insert -- a -- , after "having" and before "fluid";
Line 32, delete "cart" and insert in lieu thereof -- port --;
Line 38, delete "fool" and insert in lieu thereof -- foot --;

Column 10,
Line 2, delete the comma between "lower" and "portion";
Line 4, insert -- a -- after "having" and before "fluid";
Lines 13 and 32, delete "cart" and insert in lieu thereof -- port --;
Line 59, delete "end" and insert in lieu thereof -- and --;

Column 12,
Line 53, insert a comma after "portion";
Line 54, insert a comma after "material" and after "lower portion";

UNITED STATES PATENT AND TRADEMARK OFFICE

CERTIFICATE OF CORRECTION

PATENT NO. : 6,739,708 B2
DATED : May 25, 2004
INVENTOR(S) : Studer et al.

It is certified that error appears in the above-identified patent and that said Letters Patent is hereby corrected as shown below:

Column 13,
Line 7, insert a comma after "portion";
Line 8, insert a comma after "material" and after "portion".

Signed and Sealed this

Sixteenth Day of November, 2004

JON W. DUDAS
*Director of the United States Patent and Trademark Office*